US005695262A

United States Patent [19]

Wachtler

[11] Patent Number: 5,695,262

[45] Date of Patent: Dec. 9, 1997

[54] LIQUID PROCESSING AND SORTING SYSTEM

[76] Inventor: William R. Wachtler, 515 Encinitas Blvd., Encinitas, Calif. 92023

[21] Appl. No.: 679,857

[22] Filed: Jul. 15, 1996

[51] Int. Cl.[6] ..... A47B 77/06; G03D 17/00

[52] U.S. Cl. ..... 312/229; 312/330.1; 312/294; 312/209; 312/351; 396/641; 396/598

[58] Field of Search ..... 312/229, 294, 312/236, 308, 209, 330.1, 351, 319.5; 396/641, 643, 644, 636, 626, 629, 598; 99/444, 446; 34/192, 193; 108/24

[56] References Cited

U.S. PATENT DOCUMENTS

| | | | |
|---|---|---|---|
| 119,753 | 10/1871 | Gale | 396/641 |
| 361,070 | 4/1887 | Long | 396/629 X |
| 1,291,248 | 1/1919 | Taylor | 312/236 |
| 1,825,126 | 9/1931 | Powers | 396/641 X |
| 3,089,744 | 5/1963 | Valentine | 312/229 |
| 3,250,283 | 5/1966 | Reinfeld | 312/308 |
| 4,138,689 | 2/1979 | Montalbano | 396/643 |
| 4,402,144 | 9/1983 | Dumke | 312/229 X |
| 4,620,754 | 11/1986 | Lyeke et al. | 312/330.1 |
| 4,986,967 | 1/1991 | Nakano et al. | 34/192 X |
| 5,235,903 | 8/1993 | Tippmann | 99/446 X |
| 5,281,020 | 1/1994 | Romick | 312/308 |
| 5,392,951 | 2/1995 | Gardner et al. | 312/319.5 |
| 5,399,007 | 3/1995 | Marconet | 312/249.8 |
| 5,579,073 | 11/1996 | Ben-Yaacov | 396/598 |

*Primary Examiner*—Peter M. Cuomo
*Assistant Examiner*—James O. Hansen
*Attorney, Agent, or Firm*—John R. Duncan; Frank D. Gilliam; Donn K. Harms

[57] ABSTRACT

A liquid processing and sorting system for sequential chemical processes such as electroplating. Several trays are mounted in a stacked relationship in a housing, at least all but the lowest tray being individually movable between a use position and a storage position. Each tray is configured to hold a livid and includes a drain tube extending from a lower position of the tray and extending out of the housing through a slot running parallel to the line of tray movement so that each tray can be drained in either the use or storage position. The movable trays preferably slide along edge rails extending under tray edges parallel to the line of movement. The lowermost tray can be either fixed in the use position or may be movable as are the other trays. Preferably, an automatic system, such as hydraulic cylinders controlled by a switch, is provided to move a selected movable tray between the use and storage position as desired.

3 Claims, 2 Drawing Sheets

LIQUID PROCESSING AND SORTING SYSTEM

BACKGROUND OF THE INVENTION

This invention relates to apparatus for holding chemical process liquids in plural trays during performance of a process using those liquids and of sorting the liquids to different storage or disposal containers.

Many chemical processes, such as electroplating, photographic developing, etc., process a workpiece to be treated through a series of baths, at least some of which are hazardous. Once a hazardous process liquid has been depleted or otherwise requires disposal, stringent handling and disposal laws apply.

In conventional electroplating processes, in particular brush plating, the workpiece to be plated is supported in a laterally stationary position. The plating liquids that are applied by brush anodes to the workpiece to be plated and the liquids are allowed to run down into a catch tray system. Generally, there is a first tray for the preliminary treatment steps including a bonding step, a second tray for the plating solution so that the solution can be reused and a container for rinse water, so that the workpiece can be rinsed between the other steps. The trays are arranged in sequence along a table below the workpiece. While the amounts of treating and plating chemicals are very small, the rinse water expands the quantity of effluent approximately three fold in the normal plating process.

Some of the plating materials have been designated as hazardous wastes. In particularly nickel is considered to be a hazardous waste in concentrations greater than two parts per million. The hazardous wastes must be disposed of through complex, expensive processes.

Other, basically simple, chemical process such as the development of photographic film and paper may generate hazardous wastes. Typically, photographic development uses a sequence of at least three trays containing developer, fixer and rinse water.

Thus, it becomes very important to segregate chemical process sequence effluent into separate containers for safe and hazardous containers and to avoid introducing excessive amounts of hazardous materials into the rinse water, which would greatly increase the quantity of hazardous waste to be treated.

SUMMARY OF THE INVENTION

The above-noted problems, and others, are overcome by a processing and sorting system for liquid process solution that basically comprises a series of trays with individual drains, in a stacked relationship in a housing, each tray being individually movable between a use position and a storage position. Individual drains allow the solution in each tray to be drained into a separate container without any chance of cross-contamination, to permit reuse or convenient disposal of a minimum volume. Each drain may be operated with the tray in either the use or storage position, as desired.

If desired, the lowermost tray may be fixed in the use position, with the other trays being individually movable between a storage position adjacent to, but spaced from, the fixed tray and a use position above the fixed tray. Generally, the lowermost tray in such an arrangement would be the rinse water tray.

While the trays may be manually movable, for optimum efficiency and processing convenience, a powered moving system including a series of hydraulic cylinders connected to each movable tray and controlled by a rotary switch to select the tray to be moved into the operating position is preferred.

For simple and reliable operation, the trays are slidable on rails that extend slightly under opposite lower edges of the trays in a direction parallel to the direction of movement. This system is light weight and allows easy and convenient replacement of trays in the system, as desired. The drains comprise flexible tubes extending out of a side outlet, preferably the back side opposite the person operating the system, adjacent to the bottom of the tray. The tray bottom may be tapered downwardly toward the outlet to provide complete draining. Each drain tube extends through a slot in the housing running parallel to the support rails, so that the drain moves along the slot with the tray during movement between use and storage positions. When not in use for draining, the ends of each tube can simply maintained above the level of liquid in the corresponding tray. Or, any conventional valve arrangement may be used, including simple pinch clamps that may be clamped over the tube to close the tube during use and later be released to permit draining.

If desired, covers may be provided for each tray to reduce evaporation of liquids when the system is not being used. The covers could extend across the storage area of the housing just above the trays so that when the trays are moved into storage the tray rims would seal against the covers.

It is, therefore, an object of this invention to provide a simple and lightweight arrangement of trays for chemical process such as electroplating. Another object is to provide drains for chemical processing trays that will prevent cross contamination of exhausted solutions during disposal. A further object is to provide a processing system in which trays are moved between storage and use positions and have individual drains that can be operated in either position. Yet another object is to provide an automated system for selectively moving any one of a series of chemical processing trays between storage and use positions.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
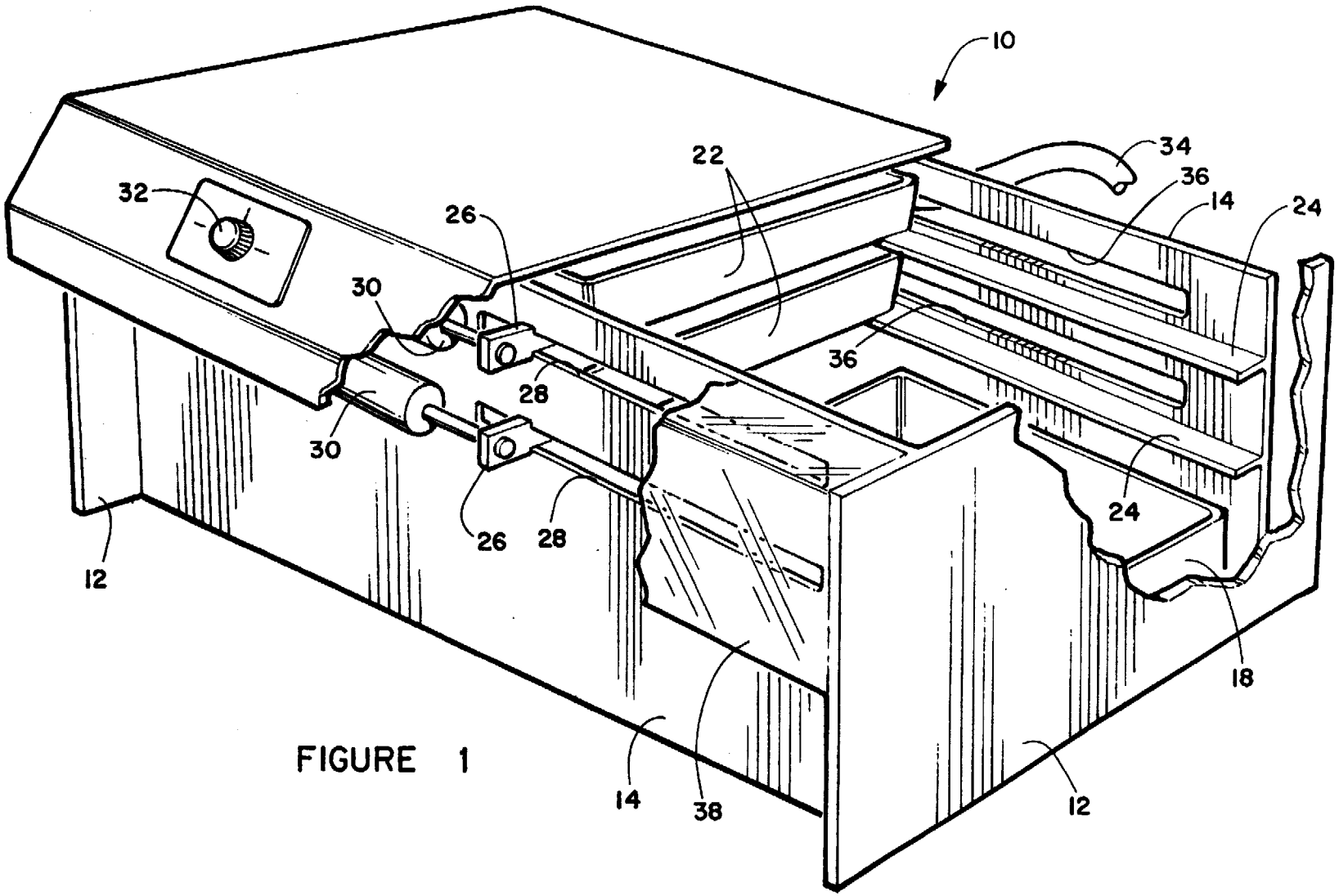
FIG. 1 is a perspective view, partly cut away, of the processing and sorting system of this invention.
Figure 3:
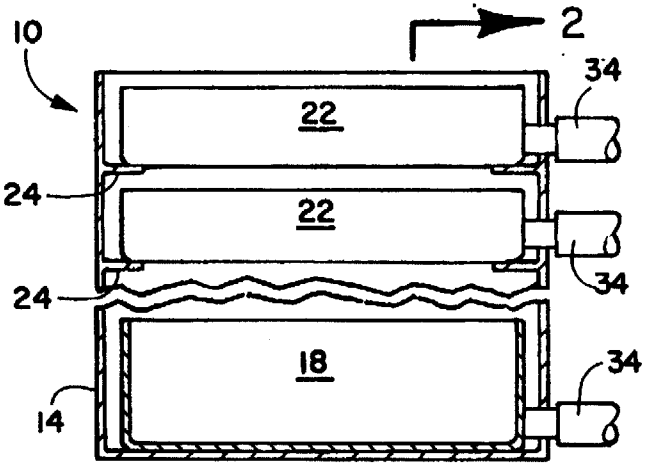
FIG. 3 is a section view, taken on line 3—3 in FIG. 2.
Figure 2:
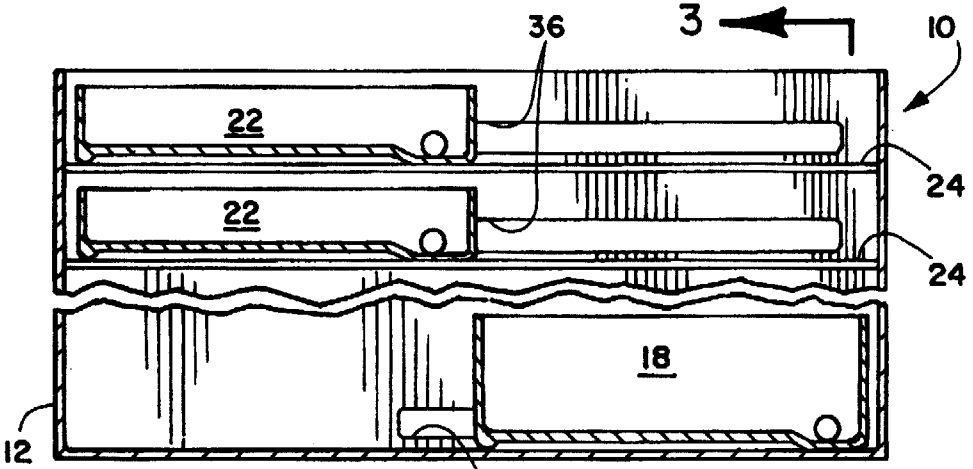
FIG. 2 is a section view, taken on line 2—2 in FIG. 3.
Figure 5:
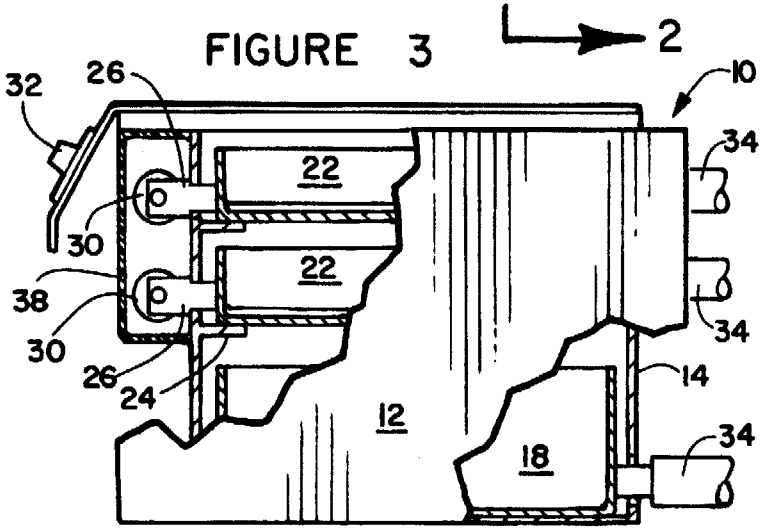
FIG. 5 is a right side elevation view, partly cut away.
Figure 4:
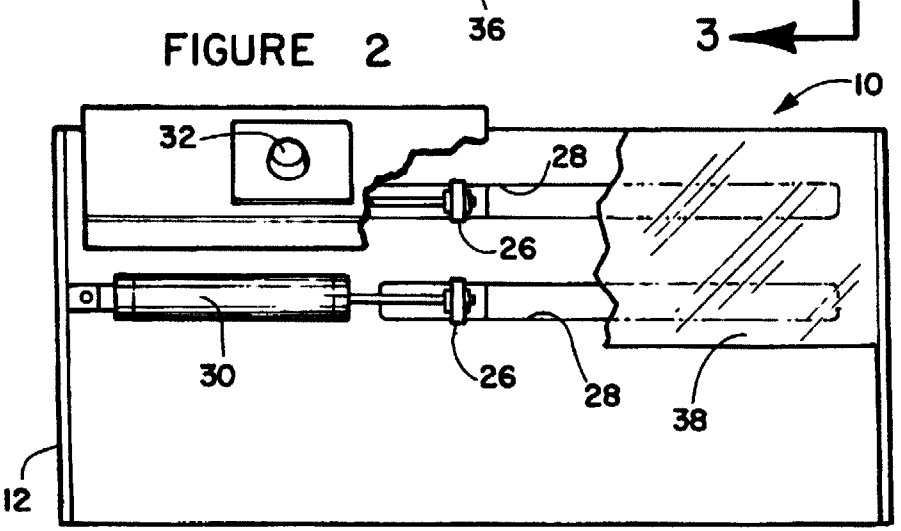
FIG. 4 is a front elevation view, partly cut away.

As shown in the Figures, the liquid processing and sorting system is contained in a housing 10 including end walls 12 and sidewalls 14. A top panel 16 covers the tray storage position while the area above the use position is open.

A lowermost tray 18 rests on base 20 of housing 10. Tray 18 may be fixed in place in the use position shown, may simply rest on base 20 or may be movable between the use position as shown an a storage position below the upper movable trays. Lower tray 18 may be slid along the floor of housing 10 manually, or may be provided with a third hydraulic cylinder 30, as detailed below. Alternatively, lower tray 18 may be provided with rails similar to rails 24 to elevate lower tray 18 above the bottom of housing 12.

A plurality, typically two or more, of movable trays 22 are slidable along rails 24 between the storage position shown and the use position above lower tray 18. Generally, all but the movable tray being used will be kept in the storage position.

An arm 26 extends from each movable tray 22 through a slot 28. A hydraulic cylinder 30 for each movable tray 22 is mounted on side wall 14 and connects to each arm 26. A conventional switch 32 is used to move either hydraulic cylinder and associated moveable tray 22 to the use position. While the hydraulic system shown is preferred, arms 26 could be moved between the two positions manually, or any other moving system, such as pneumatic cylinders, electric motors driving lead screws. If desired, lower tray 18 could have the same sort of hydraulic moving system.

Each of the trays should be drained when necessary into a separate receiving vessel (not shown) to prevent cross contamination, as discussed above. A drain hose 34 is operatively connected to each tray 18 and 22. The drain hoses 34 pass through slots 36 in sidewall 14 at the back of the unit. Thus, the hoses will move with the associated tray and can drain the tray in any position. If desired, the distal end of each drain hose 34 can simply be raised above the liquid level in the corresponding tray during use and lowered to drain the tray. Alternatively, any suitable valve can be included in each drain hose 34 to be opened for draining.

Preferably, a clear plastic cover 38 is provided over the arms 26 and the extending hydraulic pistons for safety while permitting the positions of arms 26 to be easily observed.

Thus, the tray system provides a simple and reliable system for processing work, such as parts to be electroplated, film to be developed, etc. through a series of liquid baths. The liquids, when depleted or where changes in bath compositions are desired, can be separatly drained into separate containers without the more toxic liquids contaminating the more benign liquids. Typically, movable trays 22 would contain the liquid to be used first or the more toxic liquids, while fixed tray 18 would contain rinse water or the like.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A liquid processing and sorting system which comprises:

a housing having a closed-topped storage portion and an open-topped use portion;

a plurality of movable trays mounted in a stacked relationship in said housing and individually laterally movable between a use position in said open-topped housing portion and a second, stacked storage, position in said closed-topped housing portion;

a lowermost tray fixed in said open-topped housing portion, each of said movable trays being positioned above said lowermost tray when a said movable tray is in the use position;

mechanical means for moving said movable trays between said use and storage positions;

each of said movable trays configured to hold a predetermined quantity of a liquid; and drain means comprising a flexible hose extending from a side of each movable tray through a slot in a wall of said housing, for draining liquid from each of said trays;

said drain means operable to selectively drain liquid from each of said movable trays in either of said storage and use positions.

2. The system according to claim 1 wherein said housing includes rails supporting opposite edges of at least some of said movable trays for sliding therealong.

3. The system according to claim 1 further including hydraulic cylinders connected to at least some said movable trays and control means for activating said hydraulic cylinders to move a selected one of said movable trays between said use and storage position.

* * * * *